US008267172B2

(12) United States Patent
Surjaatmadja et al.

(10) Patent No.: US 8,267,172 B2
(45) Date of Patent: Sep. 18, 2012

(54) SYSTEM AND METHOD FOR DETERMINING POSITION WITHIN A WELLBORE

(75) Inventors: Jim B. Surjaatmadja, Duncan, OK (US); Michael Bailey, Duncan, OK (US); Timothy H. Hunter, Duncan, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 264 days.

(21) Appl. No.: 12/703,366

(22) Filed: Feb. 10, 2010

(65) Prior Publication Data

US 2011/0192599 A1 Aug. 11, 2011

(51) Int. Cl.

| | |
|---|---|
| ***E21B 47/09*** | (2012.01) |
| ***E21B 43/00*** | (2006.01) |
| ***E21B 17/20*** | (2006.01) |
| ***E21B 7/08*** | (2006.01) |
| ***E21B 23/04*** | (2006.01) |

(52) U.S. Cl. ..... 166/255.1; 166/117.5; 166/242.6; 166/313; 166/381; 175/73

(58) Field of Classification Search ..... 166/50, 166/313, 117.5, 117.6, 242.1, 242.2, 242.6, 166/255.1, 381; 175/73, 67

See application file for complete search history.

(56) References Cited

U.S. PATENT DOCUMENTS

| | | | | |
|---|---|---|---|---|
| 3,273,645 | A | | 9/1966 | Der Mott |
| 3,797,589 | A | | 3/1974 | Kellner et al. |
| RE28,449 | E | | 6/1975 | Edmond |
| 4,067,386 | A | | 1/1978 | Weise |
| 4,141,414 | A | | 2/1979 | Johansson |
| 4,410,051 | A | | 10/1983 | Daniel et al. |
| 4,438,810 | A | | 3/1984 | Wilkinson |
| 4,739,842 | A | * | 4/1988 | Kruger et al. ..... 175/61 |
| 5,020,591 | A | | 6/1991 | Shore |
| 5,107,927 | A | | 4/1992 | Whiteley et al. |
| 5,259,466 | A | | 11/1993 | Venditto et al. |
| 5,273,121 | A | | 12/1993 | Kitney et al. |

(Continued)

FOREIGN PATENT DOCUMENTS

EP 0313374 A1 4/1989

(Continued)

OTHER PUBLICATIONS

Office Action dated Jun. 27, 2011 (15 pages), U.S. Appl. No. 12/639,244, filed Dec. 16, 2009.

(Continued)

*Primary Examiner* — Jennifer H Gay
(74) *Attorney, Agent, or Firm* — John W. Wustenberg; Conley Rose, P.C.

(57) ABSTRACT

A method of locating a wellbore feature, comprising delivering a mechanical position determination tool into the wellbore, selectively causing an undulating curvature of the mechanical position determination tool in response to a change in a fluid pressure, moving the mechanical position determination tool along a longitudinal length of the wellbore, and sensing a change in resistance to continued movement of the mechanical position determination tool. A mechanical position location tool for a wellbore, comprising pressure actuated elements configured to cooperate to selectively provide an unactuated state in which the mechanical position location tool lies substantially along a longitudinal axis and the pressure actuated elements further configured to cooperate to selectively lie increasingly deviated from the longitudinal axis in response to a change in pressure applied to the mechanical position location tool.

20 Claims, 3 Drawing Sheets

U.S. PATENT DOCUMENTS

| | | | | |
|---|---|---|---|---|
| 5,343,966 | A * | 9/1994 | Wenzel et al. | 175/74 |
| 5,988,286 | A | 11/1999 | Dwiggins | |
| 6,213,205 | B1 | 4/2001 | Surjaatmadja | |
| 6,234,259 | B1 * | 5/2001 | Kuckes et al. | 175/73 |
| 6,283,208 | B1 | 9/2001 | George et al. | |
| 6,336,502 | B1 | 1/2002 | Surjaatmadja et al. | |
| 6,364,038 | B1 * | 4/2002 | Driver | 175/95 |
| 6,464,003 | B2 | 10/2002 | Bloom et al. | |
| 6,662,874 | B2 | 12/2003 | Surjaatmadja et al. | |
| 6,725,933 | B2 | 4/2004 | Middaugh et al. | |
| 6,827,148 | B2 | 12/2004 | Shaw et al. | |
| 6,935,423 | B2 | 8/2005 | Kusmer | |
| 6,938,690 | B2 | 9/2005 | Surjaatmadja | |
| 6,976,507 | B1 | 12/2005 | Webb et al. | |
| 7,172,038 | B2 | 2/2007 | Terry et al. | |
| 7,188,671 | B2 * | 3/2007 | Al-Zahrani | 166/250.01 |
| 7,216,726 | B2 * | 5/2007 | Swietlik et al. | 175/73 |
| 7,278,491 | B2 | 10/2007 | Scott | |
| 7,404,416 | B2 | 7/2008 | Schultz et al. | |
| 7,497,259 | B2 | 3/2009 | Leising et al. | |
| 7,617,871 | B2 | 11/2009 | Surjaatmadja et al. | |
| 7,886,842 | B2 | 2/2011 | Howard et al. | |
| 8,061,426 | B2 * | 11/2011 | Surjaatmadja | 166/298 |
| 2006/0086507 | A1 | 4/2006 | Surjaatmadja et al. | |
| 2011/0192599 | A1 * | 8/2011 | Surjaatmadja et al. | 166/255.1 |
| 2011/0272164 | A1 * | 11/2011 | Surjaatmadja | 166/381 |

FOREIGN PATENT DOCUMENTS

| | | | |
|---|---|---|---|
| EP | 1489260 | A1 | 12/2004 |
| GB | 2452416 | A | 3/2009 |
| WO | 2010064010 | A2 | 6/2010 |
| WO | 2010064010 | A3 | 6/2010 |
| WO | 2011098767 | A2 | 8/2011 |
| WO | 2011098767 | A3 | 8/2011 |

OTHER PUBLICATIONS

Foreign communication from a related counterpart application—International Search Report and Written Opinion, PCT Application PCT/GB2009/002808, Aug. 2, 2010, 12 pages.

Office Action dated Sep. 24, 2010 (18 pages), U.S. Appl. No. 12/327,600, filed Dec. 3, 2008.

Nakhwa, A. D., et al., "Oriented perforating using abrasive fluids through coiled tubing," SPE 107061, 2007, pp. 1-7, Society of Petroleum Engineers.

Surjaatmadja, Jim B., et al., "An effective sweep-cleaning of large deviated wellbores using small coiled-tubing systems," SPE 94102, 2005, pp. 1-9, Society of Petroleum Engineers.

Notice of Allowance dated Jan. 5, 2011 (9 pages), U.S. Appl. No. 12/327,600, filed Dec. 3, 2008.

Office Action dated May 24, 2012 (28 pages), U.S. Appl. No. 12/773,481, filed May 4, 2010.

Foreign communication from a related counterpart application—International Search Report and Written Opinion, PCT/GB2011/000181, Mar. 7, 2012, 11 pages.

* cited by examiner

SYSTEM AND METHOD FOR DETERMINING POSITION WITHIN A WELLBORE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

This invention relates to systems and methods of determining a position within a wellbore.

BACKGROUND OF THE INVENTION

It is sometimes necessary to determine a position within a wellbore, for example, to accurately locate a wellbore servicing tool. A variety of position tools exist for determining a position within a wellbore. Some tools are configured to enable determination of a position within a wellbore by inserting the tool into the wellbore and causing mechanical interaction between the position tool and casing collars, pipe collars, and/or other downhole features within the wellbore. While some mechanical tools are suitable for interacting with a variety of downhole features, the tools may wear or otherwise degrade the components within the wellbore and/or may undergo an undesirable amount of mechanical wear in response to the use of the position tool. Further, some position tools are not well suited for determining a position within a wellbore that comprises components having a wide range of internal bore diameters. Accordingly, there is a need for systems and methods for determining a position within a wellbore without causing undesirable wear to the components within a wellbore and/or to the system itself. There is also a need for systems and method for determining a position within a wellbore for use with wellbores comprising components having a wide range of internal bore diameters.

SUMMARY OF THE INVENTION

Disclosed herein is a method of locating a wellbore feature, comprising delivering a mechanical position determination tool into the wellbore, selectively causing an undulating curvature of the mechanical position determination tool in response to a change in a fluid pressure, moving the mechanical position determination tool along a longitudinal length of the wellbore, and sensing a change in resistance to continued movement of the mechanical position determination tool.

Also disclosed herein is a mechanical position location tool for a wellbore, comprising pressure actuated elements configured to cooperate to selectively provide an unactuated state in which the mechanical position location tool lies substantially along a longitudinal axis and the pressure actuated elements further configured to cooperate to selectively lie increasingly deviated from the longitudinal axis in response to a change in pressure applied to the mechanical position location tool.

Further disclosed herein is a method of servicing a wellbore, comprising delivering a mechanical position location tool via a workstring into the wellbore, wherein a wellbore servicing tool is coupled to the workstring at a substantially fixed location relative to the mechanical position location tool, increasing a pressure applied to the mechanical position location tool, in response to the increasing the pressure, increasing a deviation of a curvature of the mechanical position location tool from a longitudinal axis of the mechanical position location tool, moving the mechanical position location tool within the wellbore, in response to the moving the mechanical position location tool, engaging the mechanical position location tool with a feature of the wellbore, and servicing the wellbore using the wellbore servicing tool.

DETAILED DESCRIPTION OF THE PREFERRED EMBODIMENTS

Figure 1:
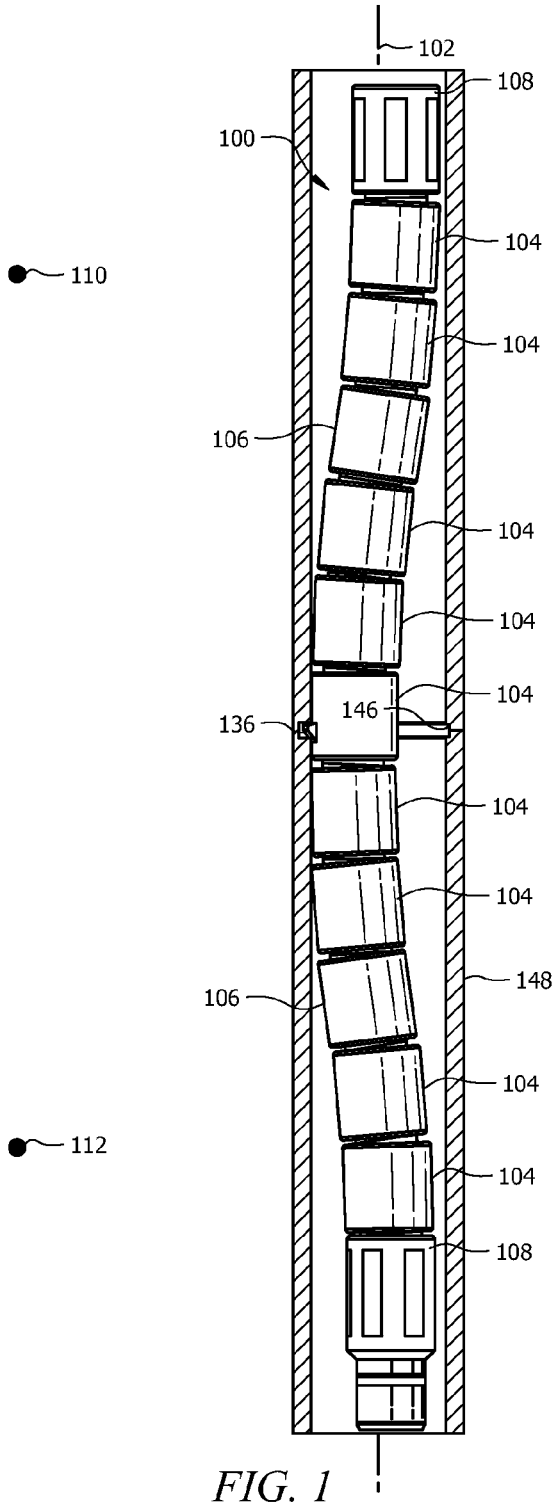
FIG. 1 is a simplified schematic view of position determination tool according to an embodiment of the disclosure.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

Disclosed herein are systems and methods for determining a position within a wellbore. In some embodiments, the systems and methods described herein may be used to pass a position determination tool (PDT) through a variety of components within a wellbore while the PDT is in an unactuated state, to actuate the PDT by increasing a fluid pressure within the PDT to cause the PDT to mechanically interfere with a component within the wellbore, and to move the PDT within the wellbore while the PDT is actuated. In some embodiments, a PDT may comprise a pressure actuated bendable tool that, on the one hand, is configured to lie generally along a longitudinal axis when unactuated, but on the other hand, is configured to deviate from the longitudinal axis in response to a change in fluid pressure. A greater understanding of pressure actuated bendable tools and elements of their design may be found in U.S. Pat. No. 6,213,205 B1 (hereinafter referred to as the '205 patent) and U.S Pat. No. 6,938,690 B2 (hereinafter referred to as the '690 patent) which are hereby incorporated by reference in their entireties. In some embodiments, the PDT may comprise a pressure actuated mechanical casing collar locator (MCCL) configured for selective actuation in response to a change in pressure and configured to locate and/or otherwise identify a collar of a tubular, pipe, and/or casing disposed in a wellbore, such as, but not limited to, a collar of a production tubing and/or casing string.

FIG. 1 is a simplified schematic diagram of a PDT 100 according to an embodiment. Most generally, the PDT 100 is configured for delivery downhole into a wellbore using any suitable delivery component, including, but not limited to, using coiled tubing and/or any other suitable delivery component of a workstring that may be traversed within the wellbore along a length of the wellbore. In some embodiments, the delivery component may also be configured to deliver a fluid pressure applied to the PDT 100. For example, in an embodiment where the delivery component used to deliver the PDT 100 is coiled tubing, the coiled tubing may also serve to deliver a selectively varied fluid pressure to the PDT 100 through an internal fluid path of the coiled tubing. While the PDT 100 is shown in an actuated state in FIG. 1, the PDT 100 may be delivered downhole and/or otherwise traversed within a wellbore in an unactuated state where the components of the PDT 100 generally lie coaxially along a longitudinal axis 102 of the unactuated PDT 100. In some embodiments, the longitudinal axis 102 may lie substantially coaxially and/or substantially parallel with a longitudinal axis of a wellbore component, such as, but not limited to, a casing string and/or a tubing string through which the PDT 100 may be traversed.

The PDT 100 generally comprises a plurality of bend elements 104, a plurality of reverser elements 106, and two adapter elements 108. Because the PDT 100 is shown in an actuated state, the bend elements 104, reverser elements 106, and adapter elements 108 cooperate to generally cause deviation of the components of the PDT 100 from the longitudinal axis 102 instead of causing the elements to lie substantially coaxially along the longitudinal axis 102. Such deviation of the PDT 100 components from the longitudinal axis 102 may be accomplished by the cooperation of the bend elements 104, reverser elements 106, and adapter elements 108. Cooperation of the bend elements 104 and the adapter elements 108 may be accomplished in any of the suitable manners disclosed in the above mentioned '205 and '690 patents. Particularly, some aspects of the bend elements 104 may be substantially similar to aspects of the members 82, 84, 86, 88 of the '690 patent while some aspects of the adapter elements 108 may be substantially similar to aspects of the adapter sub 80 of the '690 patent. Transitioning the PDT 100 between the actuated and unactuated states may be initiated and/or accomplished in response to a change in pressure applied to the PDT 100 and/or to a change in a pressure differential applied to the PDT 100 in any of the suitable manners disclosed in the above mentioned '205 and '690 patents.

While the PDT 100 may be configured to lie substantially along the longitudinal axis 102 when in an unactuated state, it will be appreciated that the interposition of the reverser elements 106 between bend elements 104 may cause an undulation in the general curvature of the PDT 100. As shown in FIG. 1, the PDT 100 comprises two reverser elements 106 which may, in some embodiments, cause the actuated PDT 100 to comprise an undulating curvature that generally correlates to a plurality of centers of curvature. For example, the actuated PDT 100 may comprise an undulating curve correlated to three distinct centers of curvature.

Figure 2:
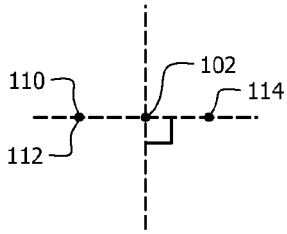
FIG. 2 is a schematic orthogonal top view showing a longitudinal axis of the position determination tool of FIG. 1 relative to centers of curvature of the position determination tool of FIG. 1.

Referring now also to FIG. 2 (a schematic orthogonal top view of the location of the longitudinal axis 102 relative to the centers of curvature described in further detail below), a first center of curvature 110 may be conceptualized as existing generally at a first radial offset from the longitudinal axis 102, in a first angular location about the longitudinal axis 102, and at a first longitudinal location relative to the longitudinal length of the PDT 100. Further, a second center of curvature 112 may be conceptualized as also existing generally at the first radial offset from the longitudinal axis 102, also in a first angular location about the longitudinal axis 102, but at a second longitudinal location relative to the longitudinal length of the PDT 100 different from the first longitudinal location of the first center of curvature 110. Still further, a third center of curvature 114 may be conceptualized as also existing at the first radial offset from the longitudinal axis 102, in a second angular location about the longitudinal axis 102 where the second angular location is angularly offset from the first angular location about the longitudinal axis 102, and at a third longitudinal location relative to the longitudinal length of the PDT 100 where the third longitudinal location is located between the first longitudinal location and the second longitudinal location.

In the above-described embodiment, the first center of curvature 110 and the second center of curvature are located in substantially the same angular location about the longitudinal axis 102 while the third center of curvature 114 is located substantially offset by about 180 degrees about the longitudinal axis from the first center of curvature 110 and the second center of curvature 112. It will be appreciated that in other embodiments, centers of curvatures of a PDT 100 may be located with different and/or unequal radial spacing, different and/or unequal angular locations about the longitudinal axis 102, and/or different and/or unequal longitudinal locations relative to the longitudinal length of the PDT.

In some embodiments, the undulating curvature of the actuated PDT 100 may simulate a sine wave and/or other wave function that generally provides at least two curve inflection points and/or two transitions between positive slope and negative slope. In other embodiments, the undulating curvature may not be uniform and/or may comprise more than two curve inflection points and/or two transitions between positive slope and negative slope. Further, while the curvature of the actuated PDT 100 shown in FIG. 1 is easily described in terms of a two dimensional curve, it will be appreciated that other embodiments may comprise three dimensional curvatures that cause the curvature of an actuated PDT 100 to exhibit a spiral, corkscrew, helical, and/or any non-uniform three-dimensional curvature.

Figure 3:
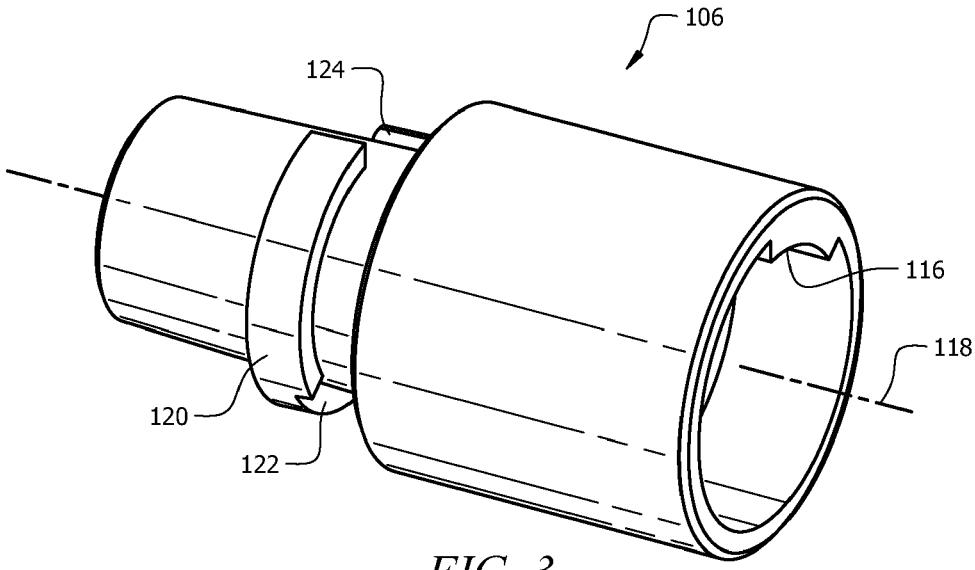
FIG. 3 is a an oblique view of a reverser element of the position determination tool of FIG. 1.

Referring now to FIG. 3, an oblique view of a reverser element 106 is shown. Reverser element 106 is substantially similar to bend elements 104 but for the location of a reverser lug 116. The reverser element 106 may be described as comprising a reverser longitudinal axis 118 that generally lies coaxially with longitudinal axis 102 when the PDT 100 is in the unactuated state. The reverser element 106 further comprises a reverser ring 120 that has a reverser notch 122 and a reverser channel 124 angularly offset about the reverser longitudinal axis 118 from the reverser notch 122. The relative locations of the reverser notch 122 and the reverser channel 124, in this embodiment, are substantially similar to the relative locations of the notch 94*a* and the channel 94*b* of the ring 94 of the '690 patent. However, unlike the lug 90*a* of the '690 patent, the reverser lug 116 is angularly aligned with the reverser channel 124 rather than the reverser notch 122. Accordingly, interposition of the reverser element 106 between bend elements 104 provides the undulating curvature of the actuated PDT 100 with the above described curve inflection point and/or transition between positive slope and negative slope. Of course, in other embodiments, the relative angular locations of the reverser lug 116, the reverser notch 122, and the reverser channel 124 may be different to provide any one of the above-described three-dimensional curvatures.

Figure 4:
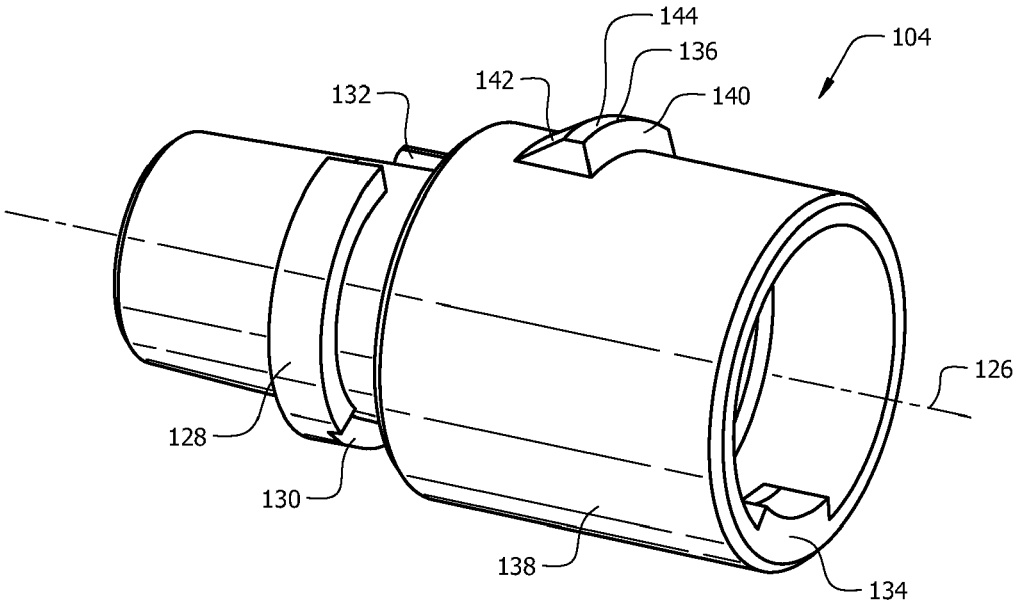
FIG. 4 is an oblique view of a bend element of the position determination tool of FIG. 1.

Referring now to FIG. 4, an oblique view of a bend element 104 is shown. The bend element 104 may be described as comprising a bend longitudinal axis 126 that generally lies coaxially with longitudinal axis 102 when the PDT 100 is in the unactuated state. The bend element 104 further comprises a bend ring 128 that has a bend notch 130 and a bend channel 132 angularly offset about the bend longitudinal axis 126 from the bend notch 130. The relative locations of the bend notch 130, the bend channel 132, and a bend lug 134, in this embodiment, are substantially similar to the relative locations of the notch 94*a* and the channel 94*b* of the ring 94 of the '690 patent. In other embodiments, the relative angular locations of the bend lug 134, the bend notch 130, and the bend channel 132 may be different to provide any one of the above-described three-dimensional curvatures.

Referring now to FIGS. 1 and 4, one or more bend elements 104 may be provided with one or more feature locators 136. In an embodiment, the feature locator 136 is generally formed as a wedge shaped protrusion extending radially from a body 138 of the bend element 104. In this embodiment, the feature locator 136 comprises an engagement surface 140 and a slip surface 142. Each of the engagement surface 140 and the slip surface 142 extend from the body 138 to an outermost radial surface 144. However, the slope of the engagement surface 140 and the slope of the slip surface 142 are different so that when the feature locator 136 interacts with a feature of a wellbore, such as a casing collar 146 of a casing 148, a force required to disengage the feature locator 136 may be different in a first longitudinal direction as compared to a force required to disengage the feature locator 136 from the feature in a second and opposite longitudinal direction. In other embodiments, a feature locator 136 may extend continuously (or discontinuously, e.g., in discrete segments) about the entire circumference of the body 138. In an embodiment, casing collar 146 may comprise a circumferential notch and/or a groove configured to engage the feature locator 136. In other embodiments, the feature locator 136 may comprise a coded profile configured to interact with selected ones of wellbore features to the exclusion of other wellbore features (e.g., selectively engaging mechanical structures and/or profiles). It will be appreciated that the feature locator 136 may be provided in a reversed longitudinal direction so that the relative forces required to engage, disengage, and/or avoid interaction with a wellbore feature may be directionally reversed.

In operation, the PDT 100 may be delivered into a wellbore or into a component of a wellbore, such as a casing 148 of a wellbore. Generally, the PDT may be delivered and/or otherwise deployed into a wellbore while the PDT 100 is in an unactuated state so that the components of the PDT 100 lie substantially along the longitudinal axis 102. The longitudinal axis 102 may be substantially coaxial with a longitudinal axis of the casing 148. By delivering the PDT 100 to a desired location within the wellbore while the PDT 100 is not actuated (and thereby minimizing contact during delivery), the PDT 100 may cause very little wear to the casing 148 and the PDT 100 itself during the delivery and/or deployment into the wellbore. Such delivery and/or deployment of the PDT 100 into the wellbore is monitored to provide operators and/or control systems feedback necessary to provide an estimated or educated guess of where within the wellbore the PDT 100 is located. Many techniques exist for calculating the estimated located of the PDT 100 during such delivery and/or deployment. A few techniques may include one or more of measuring a length of workstring and/or coiled tubing used to deploy the PDT 100, measuring and/or monitoring a weight of the delivery device, and/or any other suitable method of estimating a location of the PDT 100 within the wellbore.

Such an estimated location of the PDT 100 may be correlated with knowledge of the wellbore contents so that upon reaching an estimated depth or longitudinal location within the wellbore, the user and/or control system may reasonably expect that a wellbore feature such as a casing collar 146 may be near the PDT 100. Once the PDT 100 is deployed so that feature locator 136 is thought to be further downhole than the feature 146, the PDT 100 may be actuated. Such actuation of the PDT 100 may occur in response to a change in a fluid pressure applied to the PDT 100. In some embodiments, a fluid pressure may be increased within a workstring and/or coiled tubing that is connected to the PDT 100. The PDT 100 may be configured so that in response to the increase in fluid pressure delivered to the PDT 100 may cause the above described deviation of the PDT 100 at least until so much deviation is caused to press the feature locator 136 against an interior wall of the casing 148 generally in a first radial direction. In some embodiments, the feature locator 136 is biased against the interior wall of the casing 148 while other portions of the PDT 100, in some embodiments, the adapters 108, are similarly pressed against the interior wall of the casing 148 but in a direction opposite to that of the first radial direction. In some embodiments, the feature locator 136 may apply a force of about 100-500 lbf against the interior wall of the casing 148. Of course, in other embodiments, a PDT 100 may be configured to apply any other suitable force against the interior wall of the casing 148.

With such pressure applied to the PDT 100 and the PDT 100 being in an actuated state as described above, the PDT 100 may be moved longitudinally within the wellbore so that the feature locator encounters a wellbore feature such as a casing collar 146. In the embodiment shown, the actuated PDT 100 may be moved upward in the casing 148 until the feature locator 136 is at least partially received within the casing collar 146 (e.g., within a notch, groove, and/or lip associated with and/or defined by the casing collar). Upon such entrance of the feature locator 136 within the casing collar 146, the engagement surface 140 may contact a portion of the casing collar 146 in a manner that increases resistance to further longitudinal movement of the PDT 100. In some embodiments, the required amount of force to dislodge a feature locator 136 from a casing collar 146 may be about 1100 lbf when the PDT 100 is internally pressurized at about 1000 psi. It will be appreciated that in other embodiments, a PDT 100 may be configured to require a different amount of force to be dislodged from a wellbore feature and/or the magnitude of internal pressure required within a PDT 100 to result in varying degrees of actuation of a PDT 100 may be different. An operator and/or control system may detect the increase in resistance to moving the PDT 100 and determine that the feature locator 136 is in a particular location based on the already known structure and contents of the wellbore. Further, in other embodiments, a PDT 100 may be configured to dislodge a feature locator 136 from a wellbore feature in response to decreasing an internal pressure within the PDT 100 rather than or in addition to forcibly pulling the PDT 100 from engagement with the wellbore feature.

After such identification of a particular location within the wellbore using the PDT 100 in the actuated state, the PDT 100 may be unactuated by reducing the pressure applied to the PDT 100. After sufficient reduction in applied pressure, the PDT 100 may disengage the internal wall of the casing 148, allowing removal and/or subsequent delivery and/or location of additional positions. In some embodiments, positive identification of a particular location may be considered successful when the PDT 100 is apparently pulled free from association with a casing collar 146 with an expected amount of pulling force. If a wellbore servicing tool is attached to the delivery device that has delivered the PDT 100, calculations regarding the elastic strain of the delivery device and/or system may be used to accurately move the delivery device by a desired length within the wellbore to locate the wellbore servicing tool in a desired and/or known location relative to the position identified by the PDT 100. Some examples of wellbore servicing tools and methods that may be used in combination with the PDT 100 include, but are not limited to, pinpoint fracturing systems and methods, tubing punching systems and methods, perforation gun systems and methods, systems and method for setting zonal isolation devices and packers, systems and methods for acid work, and/or any other wellbore servicing system and/or method that may benefit from accurately locating the wellbore servicing tool within a wellbore.

Figure 5:
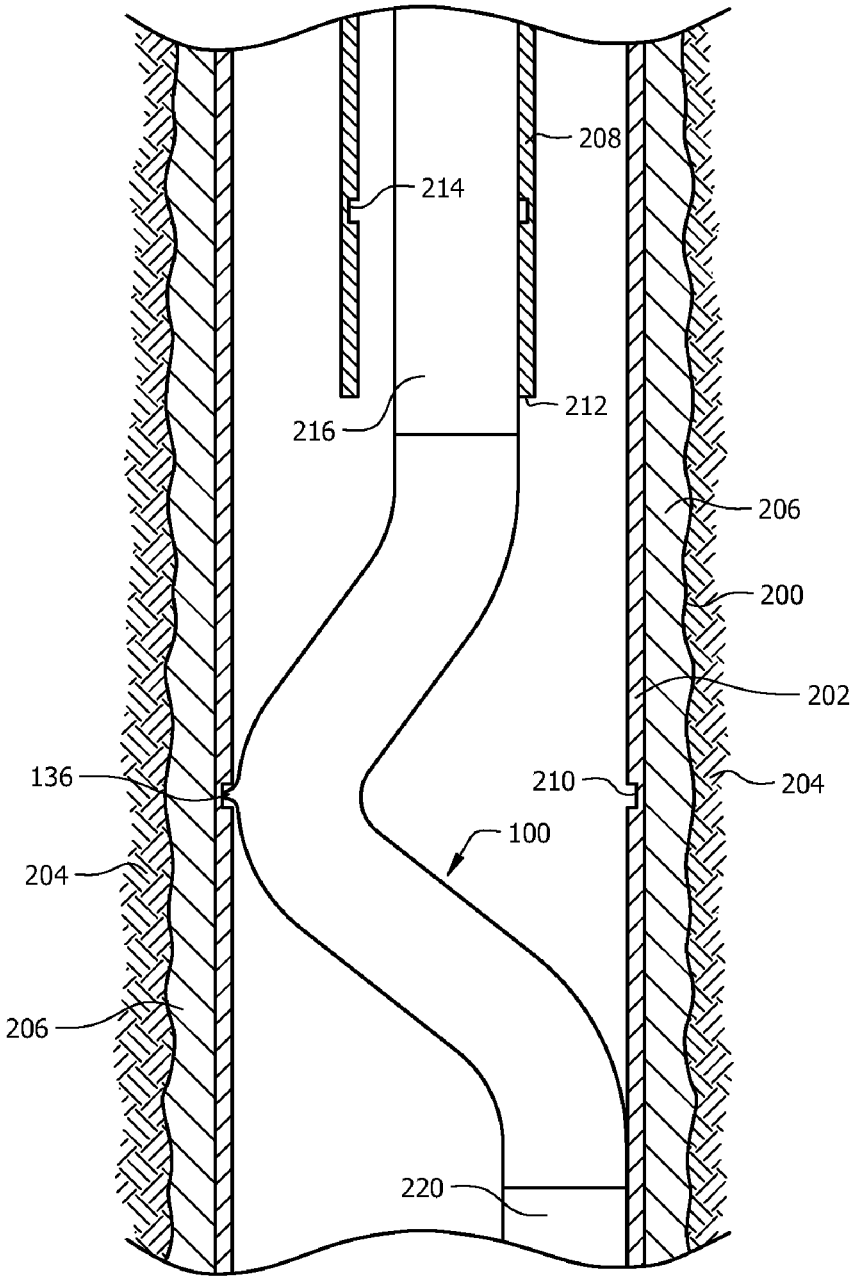
FIG. 5 is a partial cut-away view of the position determination tool of FIG. 1 as used in the context of a wellbore for performing a wellbore servicing method using a wellbore servicing device.

Referring now to FIG. 5, a partial cut-away view of a PDT 100 as deployed into a wellbore 200 is shown. The wellbore 200 comprises a casing 202 that is cemented in relation to the subterranean formation 204 through the use of cement 206. A tubing string 208 (e.g., production tubing) is disposed within the casing 202 but does not extend beyond a lower end of the casing 202. The wellbore 200 comprises a plurality of wellbore features discoverable and/or identifiable by the feature locator 136. For example, the wellbore 200 comprises, in a non-limiting sense, a lower end of the casing 202, casing collars 210, a lower end 212 of the tubing string 208, and tubing string collars 214. In this embodiment, the PDT 100 may be used to locate a plurality of the wellbore features even though the features are associated with wellbore components having vastly different internal diameters. The tubing string 208 is received within the interior of the casing 202 and the delivery device, in this case a coiled tubing 216 device, is received within the interior of the tubing string 208. In some embodiments, the internal diameter of the casing 202 may be about 7 inches, the internal diameter of the tubing string 208 may be about 5 inches, and the largest diameter of the PDT 100 (in this embodiment around the feature locator 136) may be about 3 inches. It will be appreciated that due to the flexible nature of the PDT 100, the PDT 100 may be delivered through the relatively smaller diameter of the tubing string 208 to thereafter locate wellbore features associated with the relatively larger diameter of the casing 202. It will be appreciated that the PDT 100 may be used to sense and locate wellbore features of wellbore components having a great variability in internal diameter. In some embodiments, the PDT 100 may be capable of being delivered through an internal diameter of the tubing string 208 that is about 5% to about 80% smaller than the internal diameter of the casing 202, alternatively about 5% to about 15% smaller than the internal diameter of the casing 202, alternatively about 10% smaller than the internal diameter of the casing 202.

In some embodiments, the PDT 100 may be used to accurately locate a wellbore servicing device 220, to optionally lock the wellbore servicing device 220 in place within the wellbore 200, to thereafter perform a wellbore servicing operation using the wellbore servicing device 220, and to optionally repeat the locating the wellbore servicing device 220 and perform the wellbore servicing operation accurately at various locations within the wellbore 200 despite the need to pass the PDT 100 through relatively small internal component diameters. In this embodiment, the wellbore servicing device 220 is also carried by the coiled tubing 216 device and is generally fixed relative to the PDT 100. In some embodiments, the PDT 100 and the wellbore servicing device 220 may both be carried and/or delivered by a workstring (and/or any other suitable delivery device) and the wellbore servicing 220 may be coupled to the workstring at a substantially fixed longitudinal location along the workstring relative to the PDT 100.

In an embodiment where the wellbore servicing device 220 is a pinpoint fracturing device, the wellbore servicing device 220 and the PDT 100 may be delivered through the tubing string 208 into an open interior of the casing 202 and below the lower end 212 of the tubing string 208. When the PDT 100 is estimated as being located in the above described position below the lower end 212, pressure may be increased to the PDT 100 via the coiled tubing 216 device to actuate the PDT 100 and cause the shown deviation from the longitudinal axis. The PDT 100 may be dragged upward until the feature locator 136 engages the casing collar 210. The PDT 100 may continue to be pulled upward until the feature locator 136 is judged as having become lodged in the casing collar 210. Next, the pressure delivered through the coiled tubing 216 may further be increased to perform pinpoint fracturing at the desired location relative to the located casing collar 210. After discontinuing the pinpoint fracturing, the above described methods may be used to subsequently locate one or more of the lower end 212 of the tubing string 208, and the tubing string collar 214 and to perform an associated pinpoint fracturing or other services relative to the located wellbore features. It will be appreciated that in other embodiments, the location of the wellbore servicing device 220 may be selected as any location relative to the located wellbore features by using the above-described techniques of adjusting location of the PDT 100 through actuating and/or unactuating the PDT 100. Further, the location of the wellbore servicing device 220 may be adjusted to compensate for any jumping of the delivery device if the wellbore feature is located by dislodging the feature locator 136 from the wellbore feature.

Generally, this disclosure at least describes systems and method for locating collars in wellbores despite the need to trip a mechanical collar locator through wellbore components having vastly differing internal diameters. Further, this disclosure makes clear that wellbore features may be accurately located by a mechanical collar locator using systems and methods that provide for selective engagement with wellbore features rather than mandatory engagement with wellbore features that are outside an easily estimated location within the wellbore. The systems and methods disclose a position determination tool that can located one or more of casing ends, casing collars, tubing ends, tubing collars, profile nipples, coded profile nipples, and other wellbore features using a single tool and in a single trip of the tool downhole. The disclosure further specifies that accuracy of wellbore feature location may be improved by one or more of recording and/or monitoring a weight of wellbore components within the wellbore and/or compensating for elastic strains of various delivery devices.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. The discussion of a reference in the disclosure is not an admission that it is prior art, especially any reference that has a publication date after the priority date of this application. The disclosure of all patents, patent applications, and publications cited in the disclosure are hereby incorporated by reference in their entireties.

What we claim as our invention is:

1. A method of locating a wellbore feature, comprising:

delivering a mechanical position determination tool into the wellbore;

selectively causing an undulating curvature of the mechanical position determination tool in response to a change in a fluid pressure;

moving the mechanical position determination tool along a longitudinal length of the wellbore; and sensing a change in resistance to continued movement of the mechanical position determination tool.

2. The method of claim 1, further comprising:

engaging the mechanical position determination tool with a feature of the wellbore.

3. The method of claim 2, wherein the feature of the wellbore is chosen from a group of wellbore features consisting of an end of a casing, and end of a tubing, a casing collar, a tubing collar, a profile nipple, and a coded profile.

4. The method of claim 2, further comprising:

increasing a pull force to disengage the mechanical position determination tool from the wellbore feature.

5. The method of claim 2, further comprising:

decreasing the pressure to disengage the mechanical position determination tool from the wellbore feature.

6. The method of claim 4, further comprising:

calculating an elastic strain to improve a determination of a position.

7. A mechanical position location tool for a wellbore, comprising:

pressure actuated elements configured to cooperate to selectively provide an unactuated state in which the mechanical position location tool lies substantially along a longitudinal axis and the pressure actuated elements further configured to cooperate to selectively lie in an undulating curvature deviated from the longitudinal axis in response to a change in pressure applied to the mechanical position location tool.

8. The mechanical position location tool of claim 7, further comprising:

a reverser element configured to cause a change in a sign of a slope of the undulating curvature of the mechanical position location tool when the tool is in the actuated state.

9. The mechanical position location tool of claim 7, further comprising:

a reverser element configured to cause an inflection point in the undulating curvature of the mechanical position location tool when the tool is in the actuated state.

10. The mechanical position location tool of claim 7, further comprising:

a reverser element comprising a longitudinal axis, a reverser channel substantially angularly aligned about the longitudinal axis with a reverser lug of the reverser element.

11. The mechanical position location tool of claim 7, further comprising:

a bend element comprising a longitudinal axis and a feature locator radially extending from a body of the bend element.

12. The mechanical position location tool of claim 11, wherein the feature locator is configured for selective engagement with a feature of the wellbore.

13. The mechanical position location tool of claim 12, wherein the feature of the wellbore is chosen from a group of wellbore features consisting of an end of a casing, and end of a tubing, a casing collar, a tubing collar, a profile nipple, and a coded profile.

14. A method of servicing a wellbore, comprising:

delivering a mechanical position location tool via a workstring into the wellbore, wherein a wellbore servicing tool is coupled to the workstring at a substantially fixed location relative to the mechanical position location tool;

increasing a pressure applied to the mechanical position location tool;

in response to the increasing the pressure, increasing a deviation of a curvature of the mechanical position location tool from a longitudinal axis of the mechanical position location tool;

moving the mechanical position location tool within the wellbore;

in response to the moving the mechanical position location tool, engaging the mechanical position location tool with a feature of the wellbore; and servicing the wellbore using the wellbore servicing tool.

15. The method of claim 14, further comprising:

prior to moving the mechanical position tool within the wellbore, increasing the deviation of the curvature at least until a feature locator contacts a wall within the wellbore.

16. The method of claim 14, wherein the mechanical position location tool is passed through a tubing having a first inner diameter and the mechanical position location tool is passed into a casing having a second inner diameter, the first inner diameter being smaller than the second inner diameter by between about 5 percent to about 80 percent, prior to substantially increasing the deviation.

17. The method of claim 14, wherein the curvature comprises a three-dimensional curve.

18. The method of claim 14, further comprising:

after servicing the wellbore, decreasing the curvature;

moving the mechanical position location tool into a space having a smaller diameter relative to a prior position of the mechanical position location tool; and engaging the mechanical position location tool with a feature of the wellbore associated with the smaller diameter.

19. The method of claim 14, wherein the wellbore servicing tool is chosen from a group of wellbore servicing tools consisting of fracture tools, tubing punching tools, perforation gun tools, zonal isolation tools, packer tools, and acid work tools.

20. The method of claim 14, wherein the wellbore servicing performed is chosen from a group of wellbore services consisting of fracturing services, tubing punching services, perforation gun services, zonal isolation services, packer services, and acid work services.

* * * * *